US009155927B2

(12) United States Patent
Newton

(10) Patent No.: US 9,155,927 B2
(45) Date of Patent: Oct. 13, 2015

(54) SELF-CONTAINED SELF-ACTUATED MODULAR FIRE SUPPRESSION UNIT

(76) Inventor: Jeffrey T. Newton, Los Angeles, CA (US)

( * ) Notice: Subject to any disclaimer, the term of this patent is extended or adjusted under 35 U.S.C. 154(b) by 1024 days.

(21) Appl. No.: 13/035,308

(22) Filed: Feb. 25, 2011

(65) Prior Publication Data

US 2011/0278029 A1 Nov. 17, 2011

Related U.S. Application Data

(60) Provisional application No. 61/395,302, filed on May 11, 2010.

(51) Int. Cl.

| | |
|---|---|
| ***A62C 35/13*** | (2006.01) |
| ***A62C 37/10*** | (2006.01) |
| ***A62C 37/14*** | (2006.01) |
| ***A62C 37/36*** | (2006.01) |
| ***A62C 37/38*** | (2006.01) |
| ***A62C 37/40*** | (2006.01) |

(52) U.S. Cl.

CPC ..... *A62C 35/13* (2013.01); *A62C 37/10* (2013.01); *A62C 37/14* (2013.01); *A62C 37/36* (2013.01); *A62C 37/38* (2013.01); *A62C 37/40* (2013.01)

(58) Field of Classification Search

CPC ..... A62C 37/40; A62C 35/13; A62C 37/14; A62C 37/36

USPC ..... 169/51, 37, 16, 19–20; 220/480–482, 220/476

See application file for complete search history.

(56) References Cited

U.S. PATENT DOCUMENTS

| | | | | |
|---|---|---|---|---|
| 2,689,613 | A | 9/1954 | Whatley | |
| 3,520,368 | A | 7/1970 | Hayes | |
| 3,811,511 | A * | 5/1974 | McCulloch | 169/28 |
| 4,034,813 | A | 7/1977 | Le Day | |
| 4,293,895 | A * | 10/1981 | Kristofek | 362/147 |
| 4,532,996 | A | 8/1985 | Wilson et al. | |
| 4,691,783 | A | 9/1987 | Stern et al. | |
| 4,991,657 | A | 2/1991 | LeLande, Jr. | |
| 5,123,490 | A | 6/1992 | Jenne | |
| 5,315,292 | A * | 5/1994 | Prior | 340/628 |
| 5,441,113 | A | 8/1995 | Pierce | |
| 5,617,923 | A * | 4/1997 | Nishikubo et al. | 169/51 |
| 5,808,541 | A * | 9/1998 | Golden | 340/286.05 |
| 5,890,544 | A | 4/1999 | Love | |
| 5,952,919 | A | 9/1999 | Merrill | |
| 6,104,301 | A | 8/2000 | Golden | |
| 6,851,483 | B2 | 2/2005 | Olander et al. | |
| 6,857,478 | B1 | 2/2005 | Weber | |
| 7,147,061 | B2 | 12/2006 | Tsutaoka et al. | |
| 7,650,948 | B2 | 1/2010 | Rousseau et al. | |
| 2006/0131035 | A1 * | 6/2006 | French | 169/37 |
| 2008/0196906 | A1 | 8/2008 | Nausbaum | |

(Continued)

*Primary Examiner* — Ryan Reis
*Assistant Examiner* — Chee-Chong Lee
(74) *Attorney, Agent, or Firm* — Fulwider Patton LLP

(57) ABSTRACT

A residential fire suppression unit for providing an automated safeguard against a localized fire within a residential space. The unit includes a mounting bracket, pressurized tank of fire retardant, a dispersal nozzle and motorized valve assembly, a smoke detector, and a fire detector. The self-contained self-actuated modular fire suppression unit preferably mounts in the ceiling of a residential space and detects smoke within the space below it and sound an audible alarm. Additionally, the unit detects fire within the space below and actuates a motorized valve assembly allowing the pressurized fire retardant stored in the tank to be expelled.

4 Claims, 13 Drawing Sheets

(56) References Cited

U.S. PATENT DOCUMENTS

2008/0271903 A1 11/2008 Lindstrom et al.
2009/0001309 A1* 1/2009 Sprakel et al. ..... 251/315.01
2010/0263882 A1* 10/2010 Bodemann ..... 169/17

* cited by examiner

SELF-CONTAINED SELF-ACTUATED MODULAR FIRE SUPPRESSION UNIT

CROSS-REFERENCES TO RELATED APPLICATIONS

This application claims priority from U.S. Provisional Application No. 61/395,302, filed May 11, 2010 incorporated by reference in its entirety.

BACKGROUND

Among causes for fatal home accidents, fires and burns are the third leading cause according to a recent study. The United State's mortality rate from fires ranks eighth among the developed countries for which statistics are available. On average in the United States in 2009, someone died in a fire every 175 minutes, and someone was injured every 31 minutes. About 85% of all U.S. fire deaths in 2009 occurred in homes. In 2009, fire departments responded to 377,000 home fires in the United States, which claimed the lives of 2,565 people (not including firefighters) and injured another 13,050, not including firefighters. Although the number of fatalities and injuries caused by residential fires has declined gradually over the past several decades, many residential fire-related deaths remain preventable and continue to pose a significant public health problem. Most victims of fires die from smoke or toxic gases and not from burns.

Recognition of the risks and dangers associated with domestic fires has led to investigation of fire warning systems or fire suppression systems that can be incorporated into the architecture of a typical home. One method of residential fire suppression is to install fixed piping and dispersal nozzles throughout a structure. However, material and labor costs to install such a system in a new structure are prohibitive, and installation of such a system in an existing structure often includes additional labor and added cost making such a method financially impractical to most home owners. A second method of residential fire suppression is to install a suitable number of self-contained modular fire suppression units throughout a structure. However, prior examples of this method fail to include considerations for a practical method of servicing and or replacing essential components including tank, valve, dispersal nozzle, and perhaps most importantly the stored fire retardant. Additionally prior examples of self-contained remotely actuated modular fire suppression units often require connections to external devices and also fail to include considerations for a practical method of servicing and or replacing essential components including the tank, valve, dispersal nozzle, and the stored fire retardant.

U.S. Pat. No. 4,991,657 to LeLande, Jr. (1991), U.S. Pat. No. 5,441,113 to Pierce (1995), and U.S. Pat. No. 6,857,478 to Weber (2005) show residential fire suppression systems. Each include a source unit connected via plumbing or piping to dispersal nozzles located throughout a structure. Installation of such a system in either a new or existing structure is labor intensive and financially impractical due to the material and labor costs incurred installing the required plumbing or piping throughout a structure in addition to the installation of any pumps, tanks, and/or sensors. Retrofitting or installing such a system in an existing structure often requires additional material and labor resulting in higher costs.

U.S. Pat. No. 5,808,541 to Golden (1998) shows an embodiment of self-contained fire suppression device. This design does not adequately address the issues of installing and performing the required service for such a device, stating only that the pressure vessel may be permanently mounted to or hung above the mounting surface. This device may not be easily accessible as described and could be an impractical embodiment of a safety device.

Both U.S. Pat. No. 5,890,544 to Love and Webber (1999) and U.S. Patent Publication No. 2006/0131035 to French (2006) show self-contained remotely operated fire suppression systems. Both methods utilize a pressure vessel releasing fire retardant to suppress a localized fire. However, both methods require connections to external sensors or triggering device. These devices serve as containment and dispersal units within a fire suppression system. They are not autonomous self-actuated units.

It appears that the prior art lacks a compact, self-contained, easily mountable and releasable fire detection and suppression unit that is cost effective and suitable for easy home installation.

SUMMARY OF THE INVENTION

An improved method of residential fire suppression would be an embodiment of a self-contained self-actuated modular unit that would autonomously detect and act to suppress a localized fire. The embodiment would be economical to purchase, install, and service, providing homeowners with a flexible and economically attractive alternative to currently available methods of residential fire suppression.

Accordingly advantages are to provide an improved design and installation method for residential individual autonomous modular fire suppression units, to provide more simple, more economical means of installation, to provide a more simple, more economical means of service, to provide homeowners a choice in the number of units they wish to purchase, and to provide a functional and aesthetic embodiment that would be preferable to a common smoke detector.

DETAILED DESCRIPTION OF THE PREFERRED EMBODIMENTS

The present invention may take many forms and various embodiments will fall within the framework of the invention's scope. The following description, aided by the accompanying drawings, are provided to illustrate the present invention. While exemplary, the descriptions herein should not be construed as limiting in any way, other than to establish that the plain and ordinary meaning of the words of the appended claims are confirmed by the description and drawings.

Figure 1:
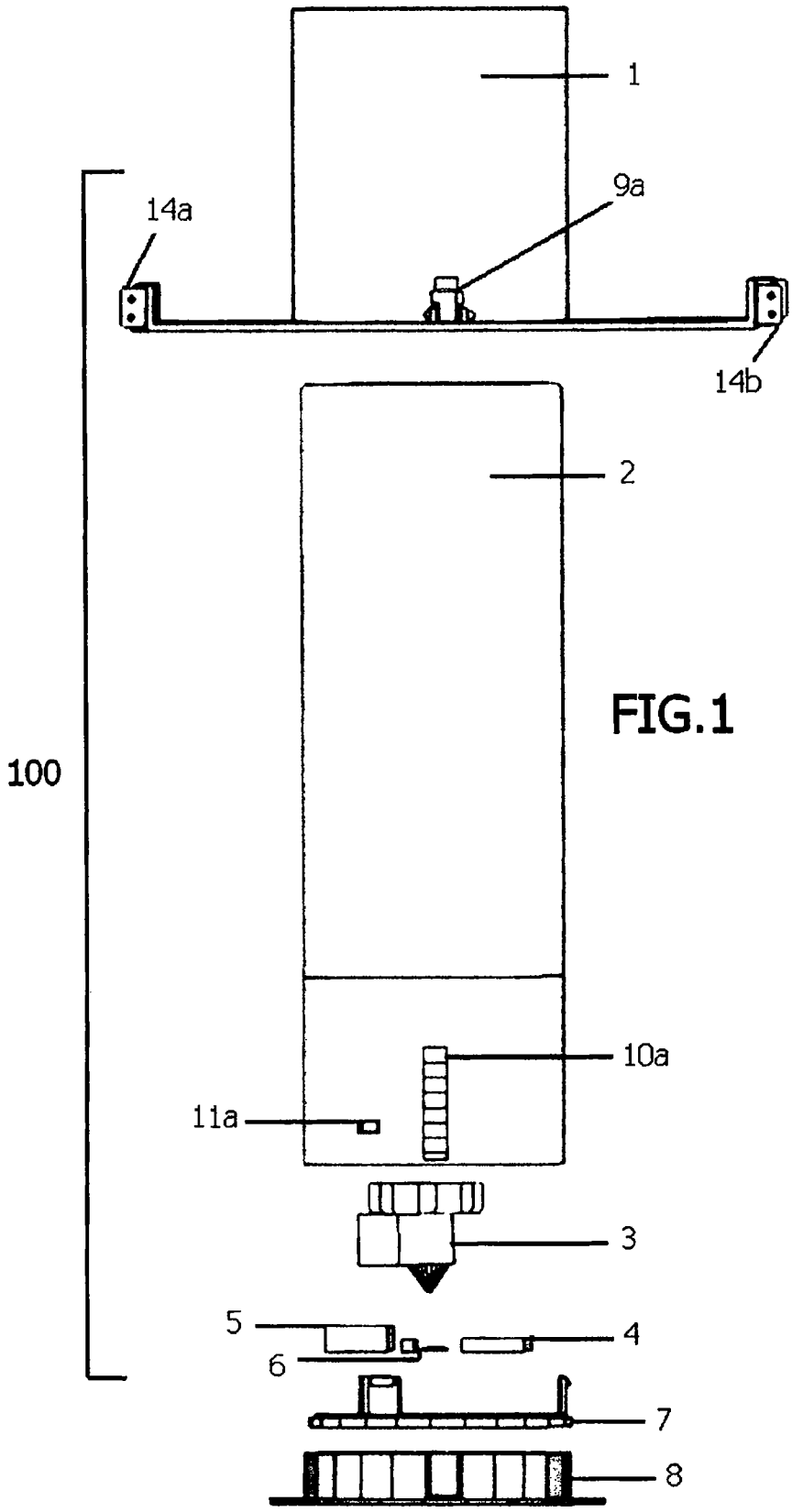
FIG. 1 is an exploded view of a first preferred embodiment of the present invention.

FIG. 1 depicts an embodiment of an exploded front view of a self-contained self-actuated modular fire suppression unit 100. The fire suppression unit 100 includes a mounting bracket 1 including a cylindrical sleeve mated to a platform for securing the unit 100 to a ceiling structure. The unit 100 includes a pressurized tank 2 having a motorized nozzle 3, a battery unit 4, a circuit board 5, a fire detection unit 6, a tank cover 7, and a decorative flange 8. The bracket 1 is shown with telescoping bar hangers 14*a,b*, a pawl 9*a*, and the tank 2 is shown with a linear ratchet 10*a*, and cover latch indent 11*a*.

Figure 2:
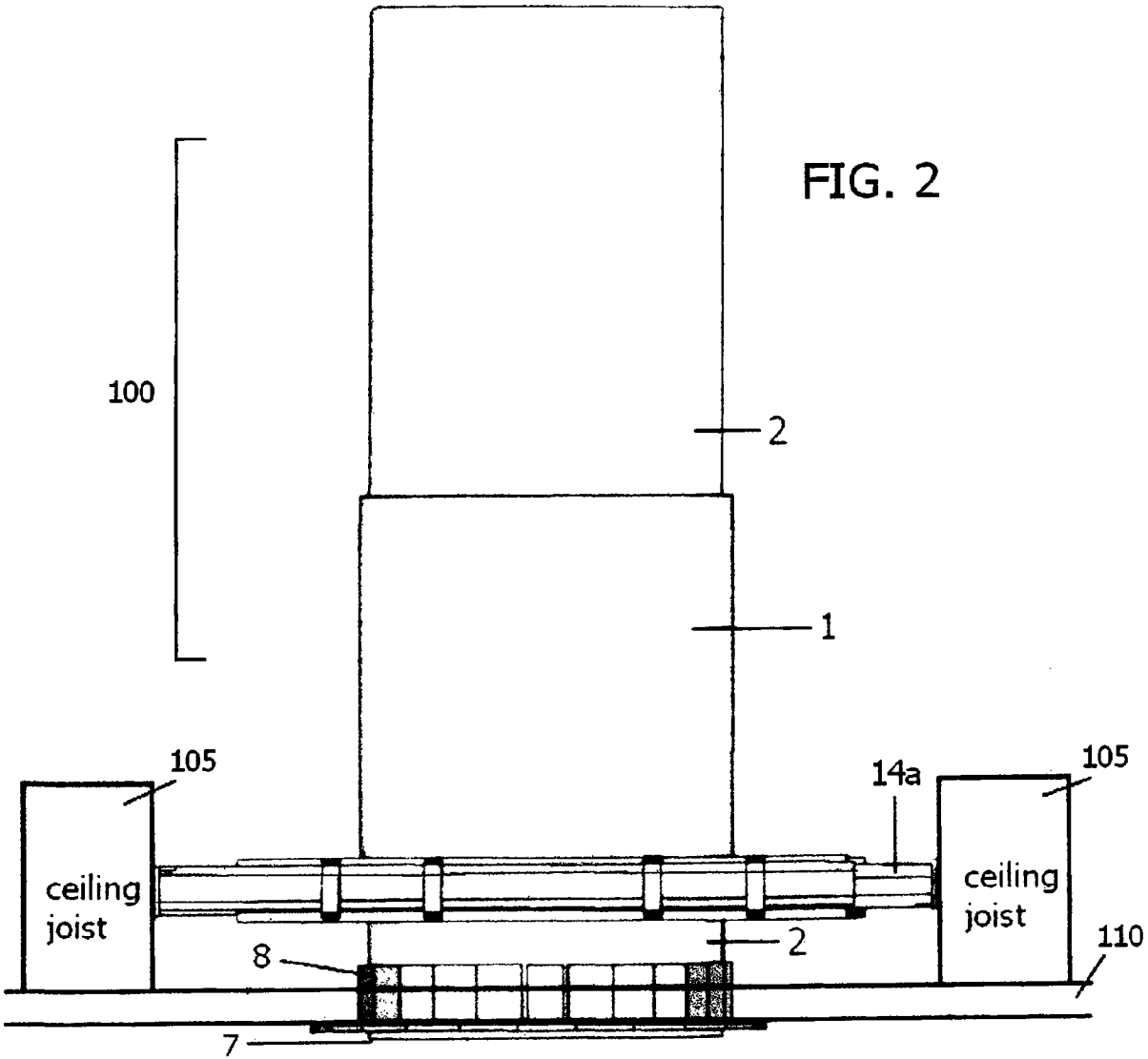
FIG. 2 is an assembled side view of the embodiment of FIG. 1.
Figures 3, 4:
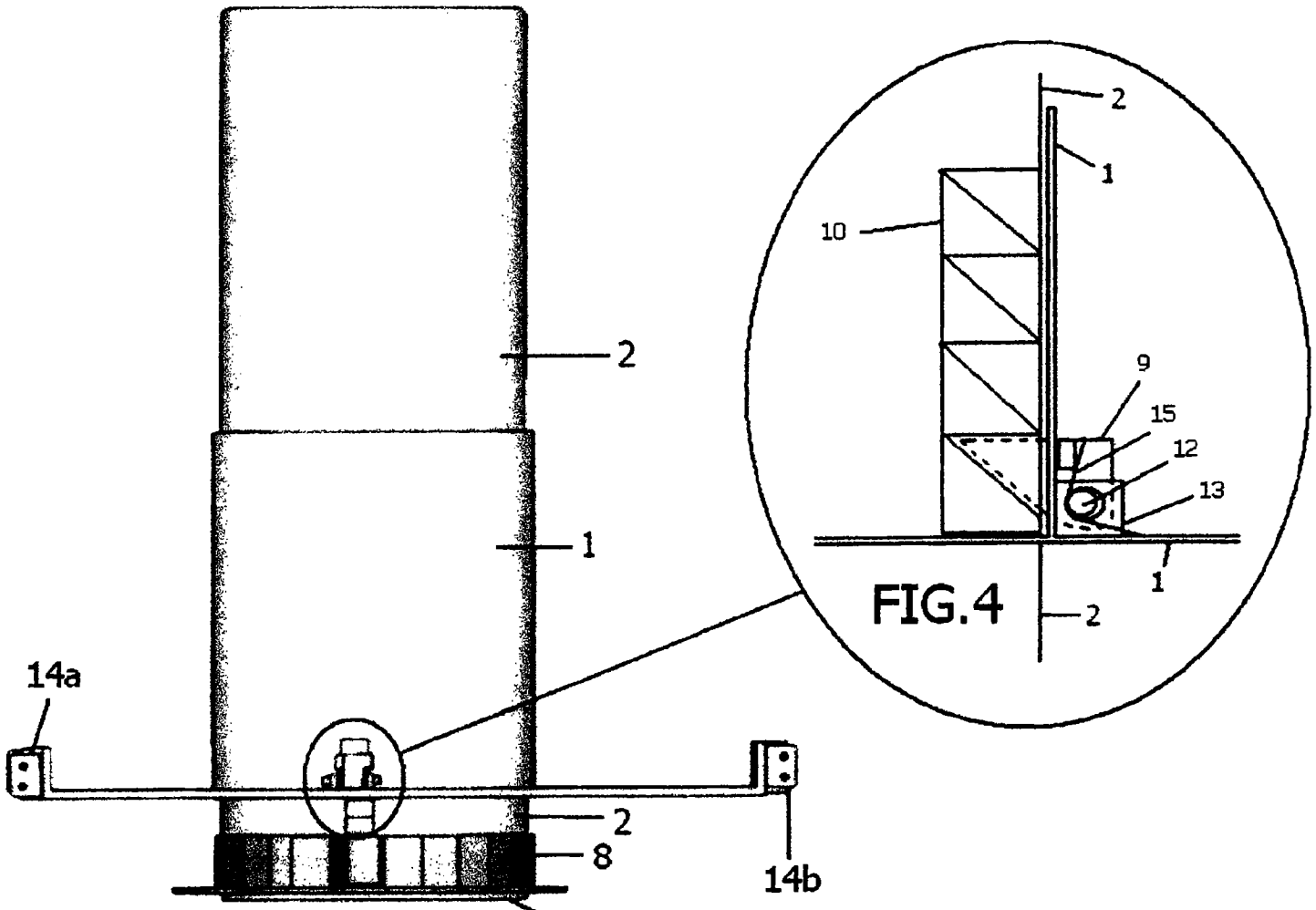
FIG. 3 is a front view of the embodiment of FIG. 1.
FIG. 4 is an enlarged, side view of a pawl and linear ratchet assembly from FIG. 3.

FIGS. 2 and 3 illustrate the unit 100 installed at a ceiling 110, being attached to the ceiling joists 105 with nails or screws (not shown) at the telescoping bar hangers 14*a*, 14*b*. The hangers are extended to the desired length such that the bracket spans the distance between the two adjacent joists, whereupon the fasteners are used to secure the bracket 1 as shown. Once the bracket 1 is securely in place, the pressure cylinder 2 is inserted and properly secured into the mating cylindrical sleeve. The decorative flange 8 is installed for the purpose of providing an aesthetic finish around the face of the cover 7. As shown in FIG. 3, the bracket 1 includes a pawl 9 used to attach the tank 2 to the bracket 1 via a ratchet 10*a*. FIG. 4 illustrates the relationship and function of the linear ratchet 10 and the pawl 9. As the tank 2 is slid into the sleeve of the bracket 1, the pawl 9 engages the ratchet 10 to positionally lock the tank in the bracket. The pawl 9 is attached to the mounting sleeve 1 by means of a thru pine 12 inserted thru two pillow blocks 13, one on either side of the pawl 9. The diameter of the thru pin 12 is such to allow the pawl 9 to pivot thereabout. A torsion spring 15 is secured at one end to the bracket's platform and at the other end to the pawl 9 to apply a torsional biasing force. This biasing force serves to push the pawl 9 forward against the ratchet 10. As the pressure cylinder 2 is inserted into the mounting sleeve of the bracket 1, the pawl 9 sequentially engages the indents of the linear ratchet 10 by the force of the torsion spring 15. The linear ratchet 10 and the pawl 9 each having a complimentary profile allow for uni-directional selective engagement wherein the pawl 9 is allowed to ride over individual indents of the linear ratchet 10 in one direction, but lock into an indent in the opposite direction for the purpose of allowing the mounting sleeve 1 to receive, secure and release the tank 2 of the self-actuated modular fire suppression unit 100.

Figure 5A:
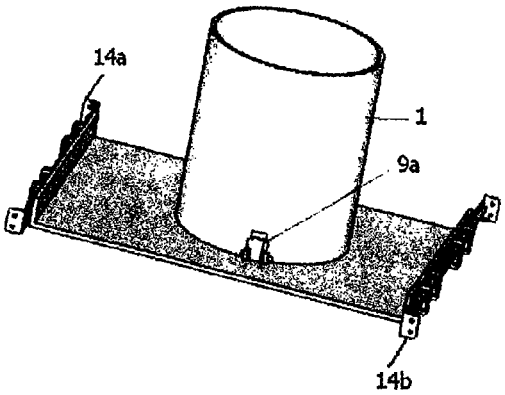
FIG. 5*a* is an elevated perspective view of a mounting sleeve.
Figure 5B:
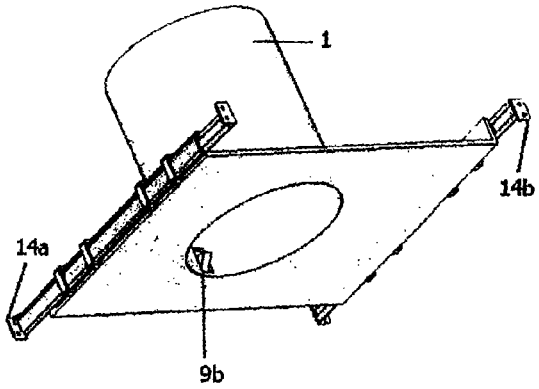
FIG. 5*b* is another perspective view of the mounting sleeve of FIG. 5*a;*

FIGS. 5*a* and 5*b* illustrate the mounting bracket 1 and cylindrical sleeve perpendicular to the platform or base. As set forth above, the bracket 1 includes telescoping bar hangers 14*a, b* for the purpose of connecting the mounting bracket 1 to ceiling joists 105 by use of nails, screws, or other fasteners. The pawls 9*a, b* receive and engage the indents of the linear ratchets 10*a, b* on the tank 2. With the bracket securely mounted in the ceiling, the tank can be reliably slid into the bracket until the pawl 9 locks against the ratchet 10.

Figure 6:
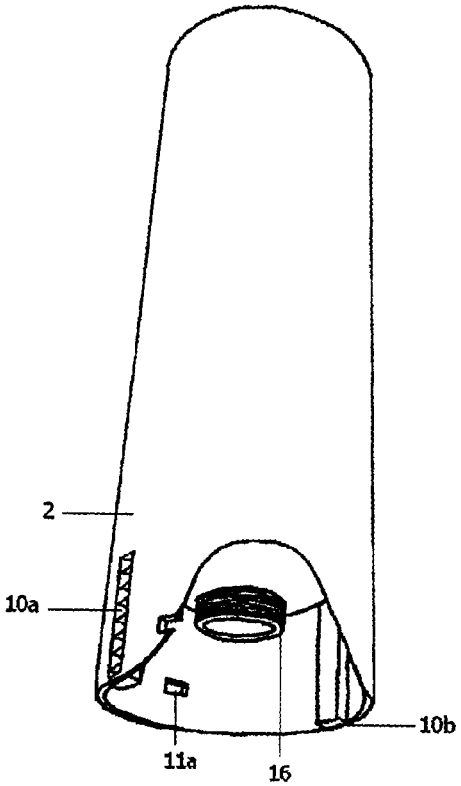
FIG. 6 is a perspective view, partly in cross-section, of a tank of the embodiment of FIG. 1.

FIG. 6 illustrates the pressure tank 2 and linear ratchets 10*a, b*. The tank 2 may include an externally threaded neck 16 that receives the internally threaded passway of a motorized dispersal unit comprised of the dispersal nozzle 35 and motorized valve assembly 3 (see, e.g., FIGS. 9*a*,9*b*). The linear ratchets 10*a, b* receive the pawls 9*a, b* on the mounting bracket 1. Lid latch indents 11*a-c* are preferably spaced evenly within the inner radial wall surface at the open end of the tank 2 for receiving complimentary lid locks 29*a-c* (FIG. 8), allowing the lid 7 to be releasably secured to the tank 2.

Figure 7:
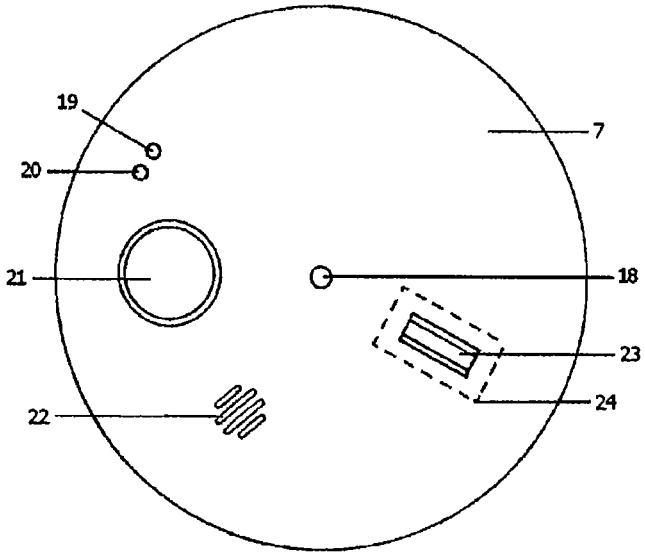
FIG. 7 is a planar view of the cover of the embodiment of FIG. 1.

FIG. 7 illustrates the front or face of the tank's lid 7. The lid 7 supports a indicator 19, a reset button 20, a smoke sensor 21, a piezo aperture 22, a frangible glass bulb 23, a frangible glass bulb housing 24, and nozzle port 18. The indicator 19, being part of a circuit board 25, may be a light emitting diode that provides a visual indication of the smoke detector's status. The reset button 20, mounted on the circuit board 25, may be manually depressed to either test the smoke sensor 21 or silence an audible alarm if the smoke sensor 21 is triggered. The smoke sensor 21 includes an aperture (not shown) located on the face of the lid 7 with a plurality of slots to allow smoke to enter into the smoke sensor 21. The piezo aperture 22 is a plurality of slots in the front or face of the lid 7 for the purpose of allowing the audible alarm generated by the piezo element to emit from the lid 7. The nozzle port 18 may be a single round aperture in the center of the lid 7 that couples to the dispersal nozzle. The frangible glass bulb housing 24, show partially in phantom, secures the frangible glass bulb 23 to the lid 7 wherein the frangible glass bulb 23 is exposed to the ambient temperatures present at the front or face of lid 7 for the purpose of detecting the heat of a fire.

Figure 8:
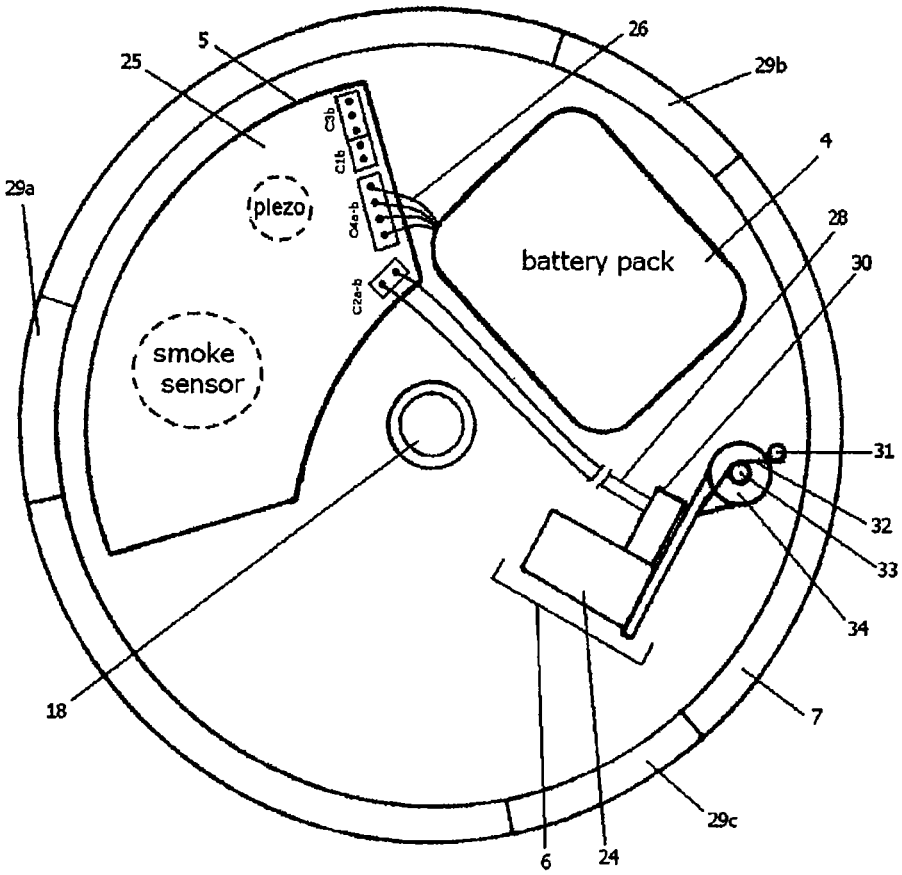
FIG. 8 is a schematic of the cover as assembled.

FIG. 8 illustrates the back of the lid, along with lid locks 29*a-c*, circuit board 25, circuit board enclosure 5, battery pack 4, nozzle port 18, frangible glass bulb housing 24, connecting wires 26, 28, microswitch 30, spring stop boss 31, torsion spring 32, crank arm retaining hardware 33, and crank arm 34. The lid locks 29*a-c* are legs spaced evenly around the radial surface of the lid 7 for the purpose of engaging the lid latch indents 11*a-c* and allowing the lid 7 to be releasably secured to the tank 2. The circuit board enclosure 5 is molded from or other wise securely attached to the interior surface of the lid 7 for the purpose of receiving and securing the circuit board 25. The battery pack 4 is molded from or other wise securely attached to the interior surface of the lid 7 for the purpose of receiving and securing batteries necessary to power the circuit board 25. The connecting wires 26 connect the battery pack 4 to the circuit board 25 via connectors C4*a, b*. The frangible glass bulb assembly 6 is secured to the interior surface of the lid 7 for the purpose of holding the frangible glass bulb 23, which is exposed to the ambient temperature present at the front or face of the lid 7. The connecting wires 28 connect the frangible glass bulb assembly 6 to circuit board 25 via connector C2*a-b*. The frangible bulb acts like an electrical switch, such that when the heat from a fire causes the frangible bulb to break, the electrical circuit is open. This open circuit is recognized by the circuit board, causing a signal to be sent to the audible alarm to sound.

Figure 9A:
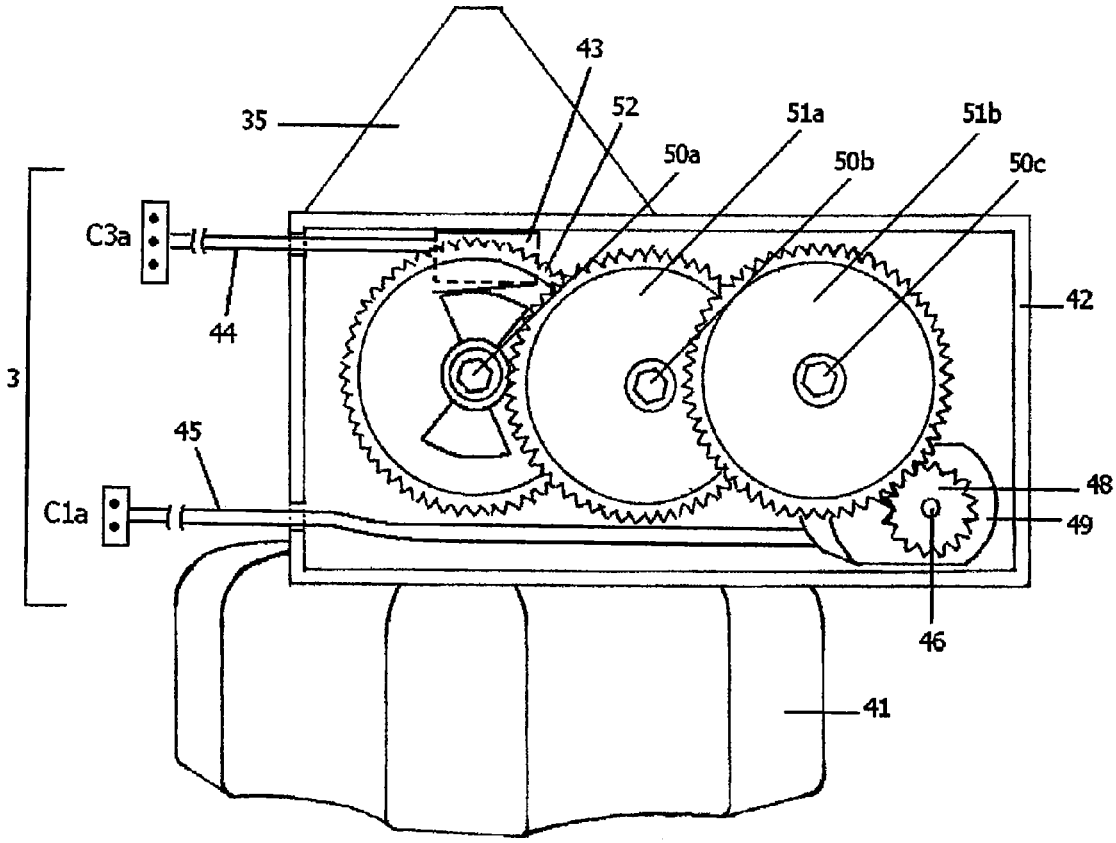
FIG. 9*a* is an inverted, side view, partly in cross-section, of a dispersal nozzle and motorized valve assembly of the embodiment of FIG. 1.

FIG. 9*a* illustrates one variation of a dispersal nozzle and motorized valve assembly 3. Gear assembly enclosure 42 includes the compound spur gear with position lobes 52, compound spur gear 51*a*, compound spur gear 51*b*, motor 49, spur gear 48, motor shaft 46, connecting wires 44, connecting wires 45, pivot bosses 50*a-c*, and microswitch 43. The connecting wires connect the motor 49 to the circuit board 25 via connectors C1*a-b*. When the circuit board 25 detects both a smoke and a fire condition within a localized area, it generates an output to motor 49 that actuates the gear assembly causing the valve ball 38 to rotate within the ball valve body 40 until the ball bore 39 is aligned to the nozzle bore 37 and the valve is "open." The connecting wires 44 connect the microswitch 43 to the circuit board 25 via connectors C3*a-b*. The microswitch 43 is actuated by the position lobes of the compound spur gear with position lobes 52 to communicate the position the valve ball 38 within the ball valve body 40 to the circuit board 25.

Figure 9B:
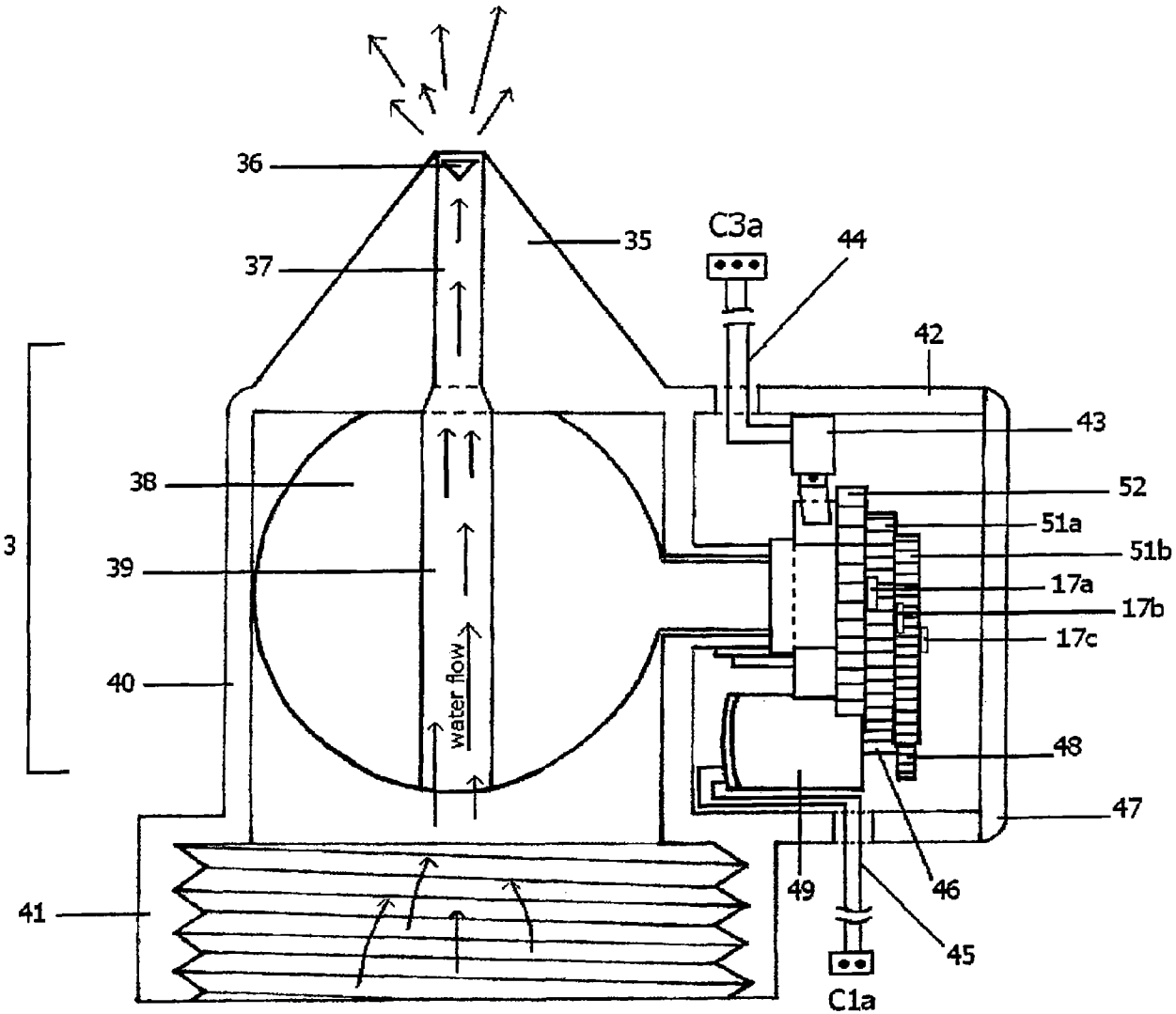
FIG. 9*b* is an inverted, front view, partly in cross-section, of a second dispersal nozzle and motorized valve assembly.

FIG. 9*b* illustrates a second variation of a dispersal nozzle and motorized valve assembly 3. The valve assembly 3 includes a compound spur gear with position lobes 52, compound spur gear 51*a*, compound spur gear 51*b*, motor 49, spur gear 48, motor shaft 46, connecting wires 44, connecting wires 45, microswitch 43, spur gear retaining hardware 17*a-c*, gear assembly enclosure lid 47, nozzle body 35, diffuser 36, nozzle bore 37, valve ball 38, ball bore 39, ball valve body 40, and internally threaded passageway 41. The connecting wires 45 connect the motor 49 to the circuit board 25 via connectors C1*a-b*. When the circuit board 25 detects both a smoke and a fire condition within a localized area it generates an output to motor 49 for the purpose of actuating the gear assembly to cause the valve ball 38 to rotate within the ball valve body 40 until the ball bore 39 is aligned to the nozzle bore 37 and the valve is "open." The connecting wires 44 connect the microswitch 43 is actuated by the position lobes of the compound spur gear with position lobes 52 for the purpose of reporting the position of the valve ball 38 within the ball body 40 to the circuit board 25. The internally threaded passageway 41 receives the externally threaded neck 16 on the tank 2. The diffuser 36 acts to disperse fire retardant material passing thru the ball valve assembly into an even radius.

Figure 10A:
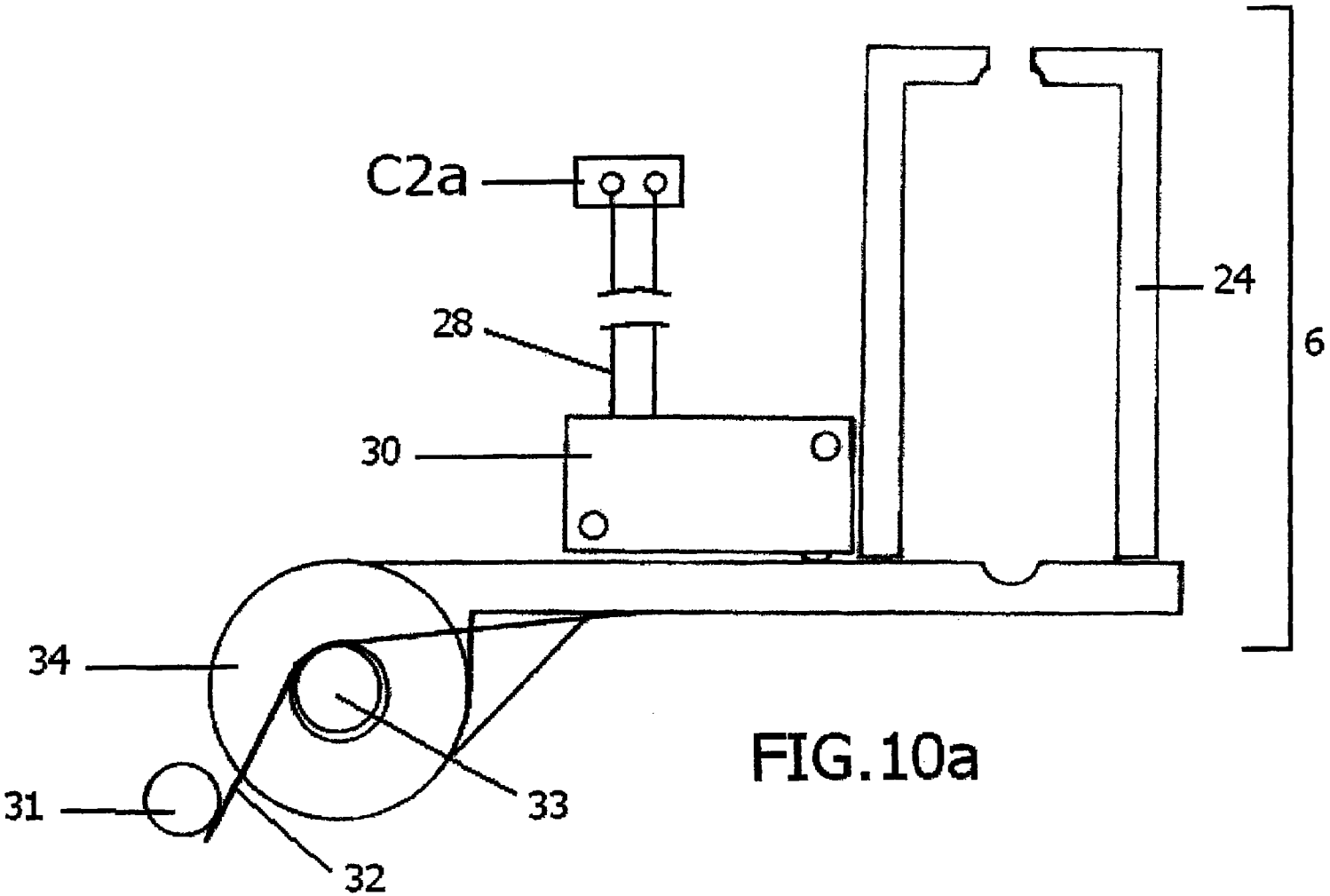
FIG. 10*a* is an enlarged, top view of a frangible bulb housing assembly.
Figure 10B:
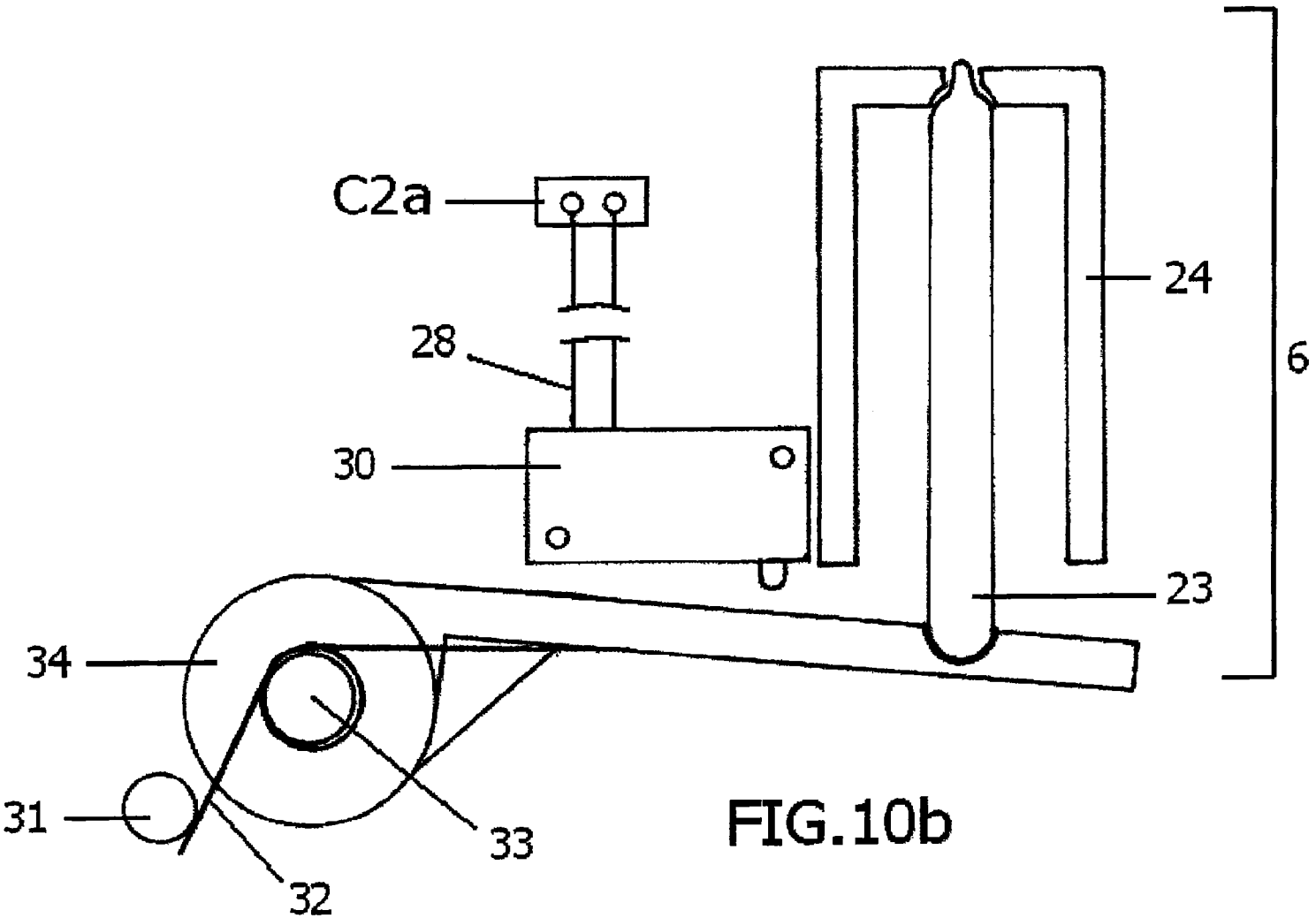
FIG. 10*b* is an enlarged, top view of the frangible bulb housing assembly of FIG. 10*a* with frangible bulb.
Figure 10C:
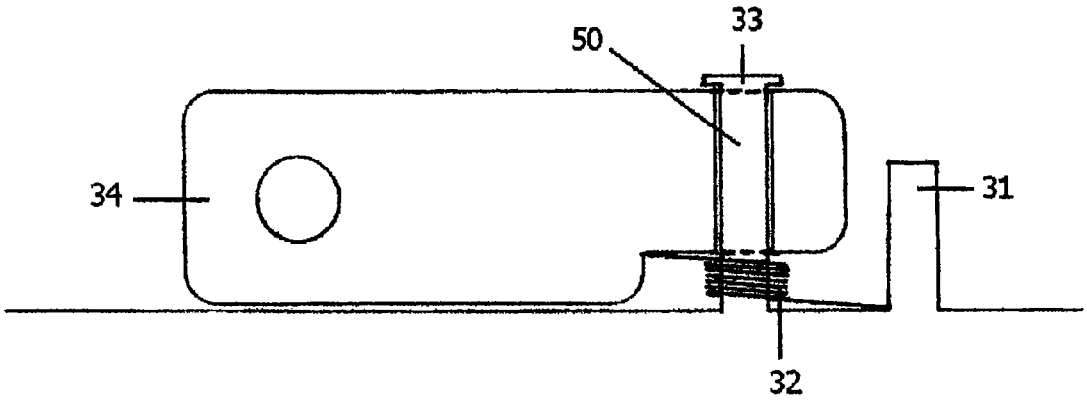
FIG. 10*c* is an enlarged side view of crank arm.

FIG. 10*a* shows a frangible glass bulb assembly 6 with the frangible glass bulb 23 omitted. In the absence of a frangible glass bulb 23 within the frangible glass bulb housing 24, the torsion spring 32 being secured at one end by the spring stop boss 31 and at the other end by the crank arm 34 acts to apply a torsional force pushing the crank arm 34 forward to depress the microswitch 30, initiating a change of state. FIG. 10*b* shows the frangible glass bulb assembly 6 with a frangible glass bulb 23 installed. FIG. 10*c* shows the crank arm 34 mechanism, the spring stop boss 31 molded from or other wise securely attached to the frangible glass bulb assembly 6. The pivot boss 50 is molded from or other wise securely attached to the frangible glass bulb assembly 6. The torsion spring 32 is secured at one end by spring stop boss 31 and at the other end by the crank arm 34, so as to apply a torsional force that acts to push the crank arm 34 forward.

Figure 11:
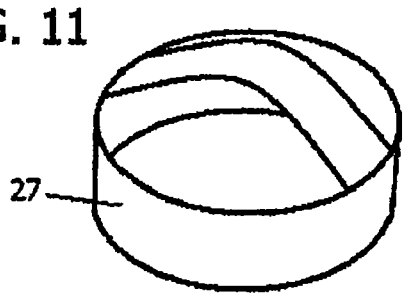
FIG. 11 is a perspective view of a removal tool.

FIG. 11 illustrates a removal tool 27 that may be used to release the tank 2 from the bracket 1. When pushed along the tank's outer surface, the removal tool 27 lifts the pawls 9 out of the ratchets 10, allowing the tank to be removed from the bracket assembly. That is, the cylindrical body of the removal tool rides up the tank's exterior until it encounters the pawl 9, whereupon the cylindrical body rotates the pawl out of engagement with the ratchet 10. Once the pawl is disengaged, the tank 2 will slide out of the bracket so that it may be replaced or serviced.

Figure 12:
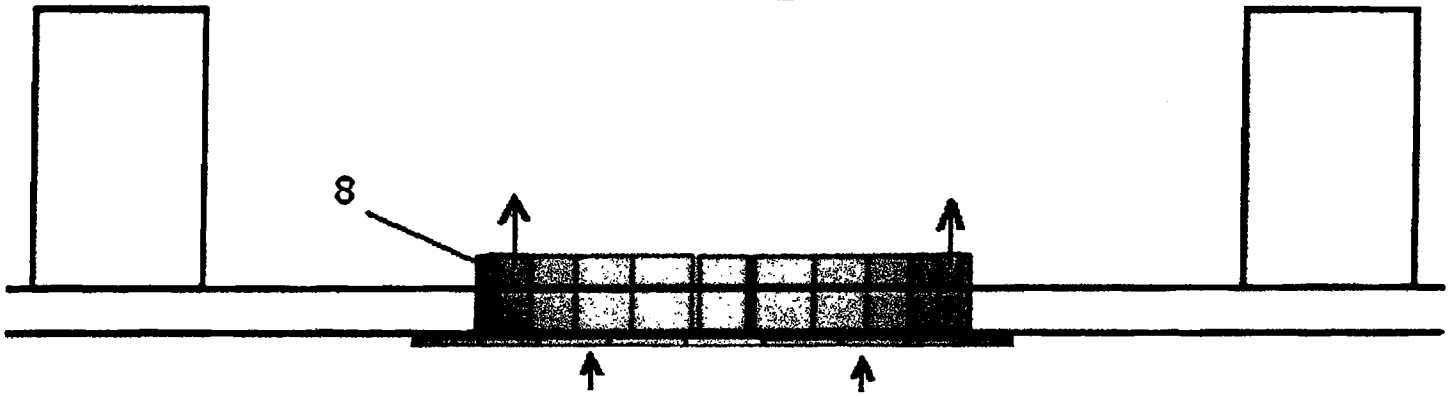
FIG. 12 is a side view of a trim ring.
Figure 13:
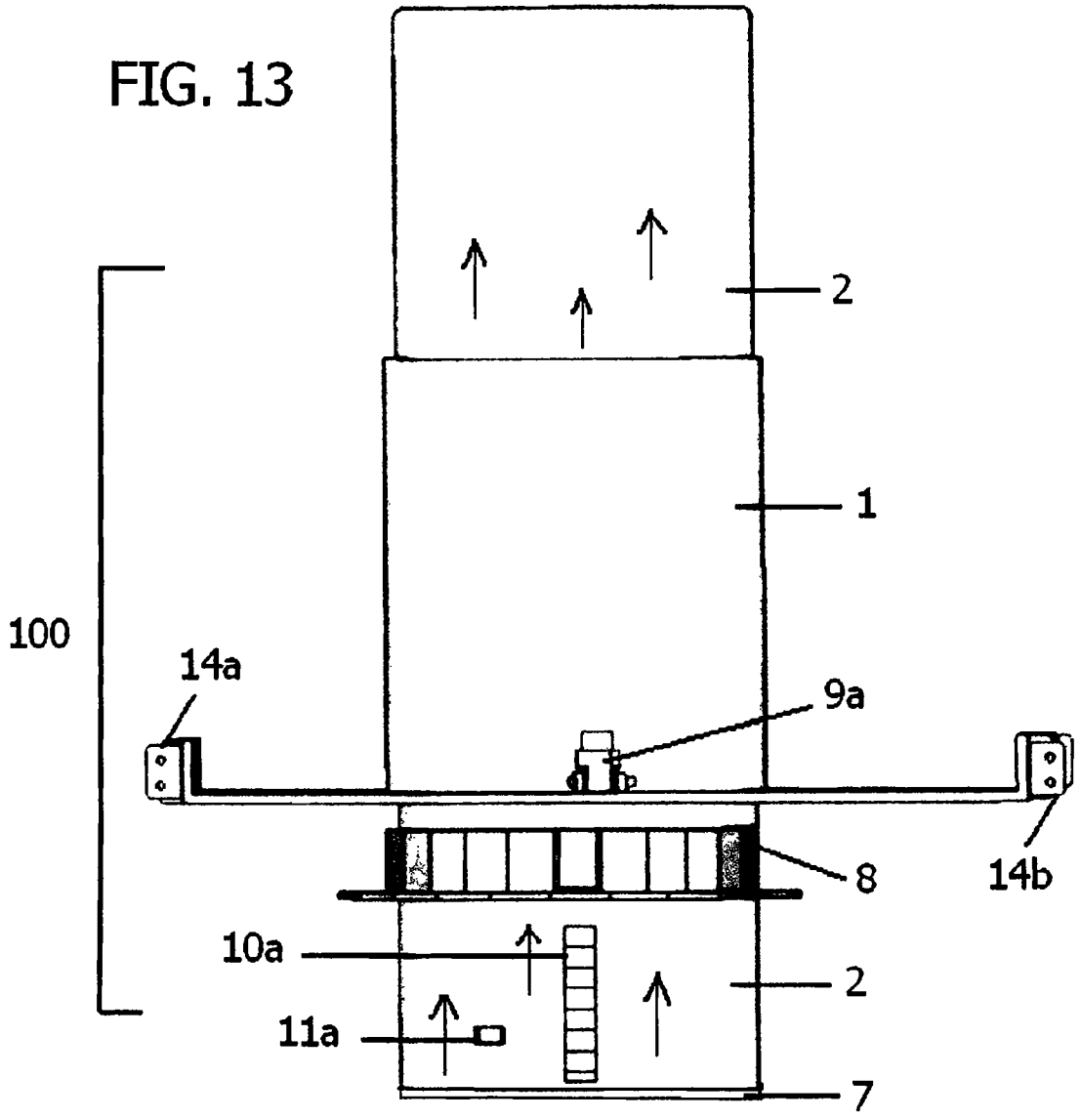
FIG. 13 is a front view of a partially installed embodiment of FIG. 1.

FIG. 12 shows decorative flange 8 for a typical ceiling installation as it would be affixed to the ceiling support structure. The decorative flange 8 includes an annular face that covers the opening where the bracket 1 is inserted. FIG. 13 is a perspective front view of a partially assembly self-contained self-actuated modular fire suppression unit 100 for the purpose of illustrating the direction and orientation of the tank 2 as it is installed into the mounting bracket 1 with the decorative flange 8 thereon.

In operation the self-contained self-actuated modular fire suppression unit 100 is mounted in the ceiling of a residential space. The unit 100 in the preferred embodiment mounts vertically (although other orientations are possible), locked within the mounting bracket 2 such that it extends through the ceiling surface and into the attic space above. If the unit 100 detects the presence of smoke within the space below via its smoke detector, it sounds an audible alarm to warn inhabitants of the presence of smoke. If the unit 100 detects the presence of smoke and thermal temperatures sufficient to rupture a frangible bulb, the unit actuates the nozzle to expel flame retardant in a predetermined spray pattern down into the space below.

The mounting bracket 1 and decorative flange 8 are properly installed as follows. The location is first determined for the self-contained self-actuated modular fire suppression unit within the ceiling space. The placement should afford optimum spray dispersal within the space and should also consider placement of existing ceiling joists. At the desired location, a hole sized to receive the unit is cut through the ceiling material creating an opening into the attic space above. The decorative flange 8 is inserted up into the opening, and bendable tabs around the insertion surface are bent over the ceiling edge to secure the decorative flange 8 to the ceiling. The mounting bracket 1 is then centered over the opening and secured in place by attaching the telescoping bar hangers 14 to the adjacent joists with nails, screws, or other fasteners.

The self-actuated fire suppression unit 100 can then be installed into the mounting bracket 1. While aligning the linear ratchet 10 on the tank 2 with the ratchet pawls 9 on the mounting sleeve 1, the unit 100 is raised through the decorative flange 8 and into the mounting bracket 1 until the lid 7 is flush with the decorative flange 8 and the pawls 9 and ratchets 10 are completely engaged and locked, securing the unit into the mounting bracket 1.

The self-actuated fire suppression unit is removed using the removal tool 27, which is used to push the unit 100 up into the mounting bracket until the pawls 9 are completely disengaged from the linear ratchets 10. The unit can then be rotated within the mounting bracket 1 until the linear ratchets 10 on the tank 2 and the pawls 9 on the mounting bracket 1 are no longer aligned. The unit is then lowered down out of the mounting sleeve 1.

I claim:

1. A self-contained self-actuated modular fire suppression unit consisting of:

a mounting bracket comprising a vertical cylindrical sleeve;

a cylindrical tank for holding fire retardant material;

a pawl and ratchet assembly for releasably locking the cylindrical tank inside the mounting bracket, the pawl and ratchet assembly automatically engaging the cylindrical tank to secure it to the mounting bracket when the cylindrical tank is inserted into the vertical cylindrical sleeve;

a portable power supply disposed below the cylindrical tank, the portable power supply providing the sole source of power for the unit and wherein when the unit is removed from the mounting bracket, the portable power supply is removed therein;

a motorized dispersal unit substantially within said cylindrical tank for dispersing fire suppression material, the motorized dispersal unit including a motorized valve assembly having at least first and second mating gears;

an electrical switch that actuates the motorized dispersal unit, the electrical switch including a frangible bulb such that the motorized dispersal unit actuates in response to a rupture of the frangible bulb, thereby completing an electrical circuit;

a smoke detection system incorporated in the unit for detecting smoke; and an audible alarm coupled to the smoke detection system for audibly signaling when the smoke detection system detects smoke.

2. A self-contained self-actuated modular fire suppression unit of claim 1, wherein the tank can be disengaged from the mounting bracket by inserting a cylindrical sleeve along the tank's outer surface to disengage the pawl and ratchet assembly.

3. A self-contained self-actuated modular fire suppression unit of claim 1, wherein the smoke detection system generates one of two outputs necessary to trigger actuation of the fire retardant dispersal system.

4. A self-contained self-actuated modular fire suppression unit of claim 1, wherein the fire retardant may be one of water, or water-based material.

* * * * *